US009355804B2

(12) United States Patent
Nakamura et al.

(10) Patent No.: US 9,355,804 B2
(45) Date of Patent: May 31, 2016

(54) FUSE HOLDER, METHOD FOR CONNECTING FUSE BY USING THE SAME, AND FUSE-CONNECTING STRUCTURE EQUIPPED WITH THE SAME

(75) Inventors: Kazuaki Nakamura, Makinohara (JP); Masayuki Hagiwara, Makinohara (JP); Kei Tomita, Makinohara (JP); Toshihide Asano, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/546,226

(22) Filed: Jul. 11, 2012

(65) Prior Publication Data

US 2013/0015941 A1 Jan. 17, 2013

(30) Foreign Application Priority Data

Jul. 12, 2011 (JP) ..... 2011-154049

(51) Int. Cl.
*H01H 85/20* (2006.01)
*H01H 85/02* (2006.01)
*H01H 85/54* (2006.01)

(52) U.S. Cl.
CPC ..... *H01H 85/0208* (2013.01); *H01H 85/547* (2013.01); *H01H 85/2035* (2013.01); *H01H 2085/208* (2013.01); *Y10T 29/49117* (2015.01)

(58) Field of Classification Search
CPC . H01H 85/165; H01H 85/2045; H01H 85/20; H01H 85/62; H01H 9/102; H01H 9/10
USPC ..... 337/186
See application file for complete search history.

(56) References Cited

U.S. PATENT DOCUMENTS

| | | | | | |
|---|---|---|---|---|---|
| 3,876,278 | A | * | 4/1975 | Battaglia et al. | 439/786 |
| 4,672,352 | A | * | 6/1987 | Takano | 337/264 |
| 5,145,414 | A | | 9/1992 | Oikawa | |
| 5,488,345 | A | * | 1/1996 | Seki et al. | 337/186 |
| 5,629,663 | A | * | 5/1997 | Seki et al. | 337/186 |
| 5,680,088 | A | * | 10/1997 | Seki et al. | 337/194 |
| 5,739,739 | A | * | 4/1998 | Muramatsu et al. | 337/234 |
| 5,781,094 | A | * | 7/1998 | Nakamura et al. | 337/238 |
| 5,818,321 | A | * | 10/1998 | Muramatsu et al. | 337/198 |
| 5,825,274 | A | * | 10/1998 | Totsuka | 337/190 |
| 5,886,612 | A | * | 3/1999 | Beckert et al. | 337/197 |
| 5,929,739 | A | * | 7/1999 | Totsuka | 337/198 |
| 6,109,973 | A | * | 8/2000 | Gronowicz et al. | 439/620.21 |

FOREIGN PATENT DOCUMENTS

| | | | | |
|---|---|---|---|---|
| JP | H03-109257 | U | 11/1991 | |
| JP | 07-169382 | A | 7/1995 | |
| JP | 07169382 | A * | 7/1995 | H01H 85/22 |

OTHER PUBLICATIONS

Office Action dated Mar. 17, 2015 issued for counterpart patent application No. JP 2011-154049.

* cited by examiner

*Primary Examiner* — Anatoly Vortman
(74) *Attorney, Agent, or Firm* — Locke Lord LLP

(57) ABSTRACT

The invention provides a fuse holder attachable to a frame and retainable a fuse, having a pair of flexible arms extending in the same direction as the fuse holder is attached to the frame and moveably attached or coupled to the frame while retaining the fuse therein.

9 Claims, 11 Drawing Sheets

FUSE HOLDER, METHOD FOR CONNECTING FUSE BY USING THE SAME, AND FUSE-CONNECTING STRUCTURE EQUIPPED WITH THE SAME

FIELD OF THE INVENTION

The present application claims priority of Japanese Patent Application No. 2011-154049 filed on Jul. 12, 2011, the disclosure of which is expressly incorporated by reference herein in its entirety.

The invention relates to a fuse holder which is capable of plugging and pulling out a fuse while retaining the fuse mounted in an electric junction box or the like. In particular, the invention relates to a fuse holder used for temporarily blocking supply of dark current into electrical components mounted in a vehicle during exportation of the vehicle.

DESCRIPTION OF THE RELATED ART

During the exportation of a vehicle, dark current continuously flows into electrical components of the vehicle for a prolonged period. As a result, a battery runs out, and an engine does not work. In order to avoid this phenomenon, a fuse is temporarily eliminated from a circuit for supplying electric power from the battery to the electrical components when the vehicle for exportation is shipped. The battery is reassembled when the vehicle is delivered to, for example, a car dealer.

Moreover, in order to avoid missing of the fuse which is taken out from the vehicle during the exportation of the vehicle, as well as, to make the operations such as plugging and/or pulling out of the fuse easy, a component "fuse holder" is often used. For more detail, see JP H7-169382A. The fuse holder is configured to plug or pull out the fuse with respect to the frame of an electric junction box while retaining the fuse therein. The fuse holder can be moveably attached to the frame from one position in which the fuse can be electrically connected to the connecting terminal disposed in the frame another position in which the fuse is disconnected or decoupled from the connecting terminal.

The conventional fuse holder as described previously is attached or coupled to the frame after the fuse is mounted to the fuse holder. On the other hand, the fuse may not be temporarily eliminated or taken out from a frame of a vehicle for domestic demand. This is because the time of transport or delivery is relatively short, and battery consumption caused by the dark current is thus not severe. In this case, only the fuse is attached to the frame. In other words, the fuse holder is not attached to the frame. As such, the process for attaching the fuse to the frame cannot be commonalized between the vehicle for domestic demand and the vehicle for export, and thereby adversely affecting production efficiency.

Furthermore, the above problem may occur in products other than the vehicle.

SUMMARY OF THE INVENTION

In order to overcome the afore-mentioned drawbacks and problems, the invention provides a fuse holder which can be attached or coupled to a frame and a fuse after the fuse is attached or coupled to the frame, a method for connecting the fuse by using the fuse holder, and a fuse-connecting structure equipped with the fuse holder.

In one aspect, the invention provides a fuse holder attachable to a frame and retainable a fuse. The fuse holder has a pair of flexible arms extending in the same direction as the fuse holder is attached to the frame. The fuse holder is moveably attached or coupled to the frame while retaining the fuse therein such that it can be situated between a first position in which the fuse is electrically connected to a connecting terminal disposed in the frame, and a second position in which the fuse is disconnected or decoupled from the connecting terminal. The pair of flexible arms is configured to sandwich the fuse therebetween, as well as, to engage with the fuse. The pair of flexible arms can be formed such that it can be bent in a direction away from each other.

In another aspect, the invention provides a method for connecting fuse by using the above fuse holder. The method specifically includes the following steps: attaching or coupling the fuse, which is not retained in the fuse holder, to the frame, and subsequently inserting the fuse holder into the frame in the same direction as the fuse is attached or coupled to the frame, thereby attaching or coupling the fuse holder to both the frame and the fuse.

In the other aspect, the invention provides a fuse-connecting structure having the above fuse holder, the above fuse, the above frame, and the above connecting terminal. The fuse has a portion with which the pair of flexible arms engages.

BRIEF DESCRIPTION OF THE DRAWINGS

The invention may be put into practice in various ways and a number of embodiments will be described by way of example to illustrate the invention with reference to the accompanying drawings, in which.

DETAILED DESCRIPTION OF THE PREFERRED EMBODIMENTS

One embodiment of a fuse holder 1, one embodiment of a method for connecting a fuse by using the fuse holder 1, and a fuse-connecting structure equipped with the fuse holder 1 will be thereafter described in detail with reference to FIGS. 1-9.

Figure 1:
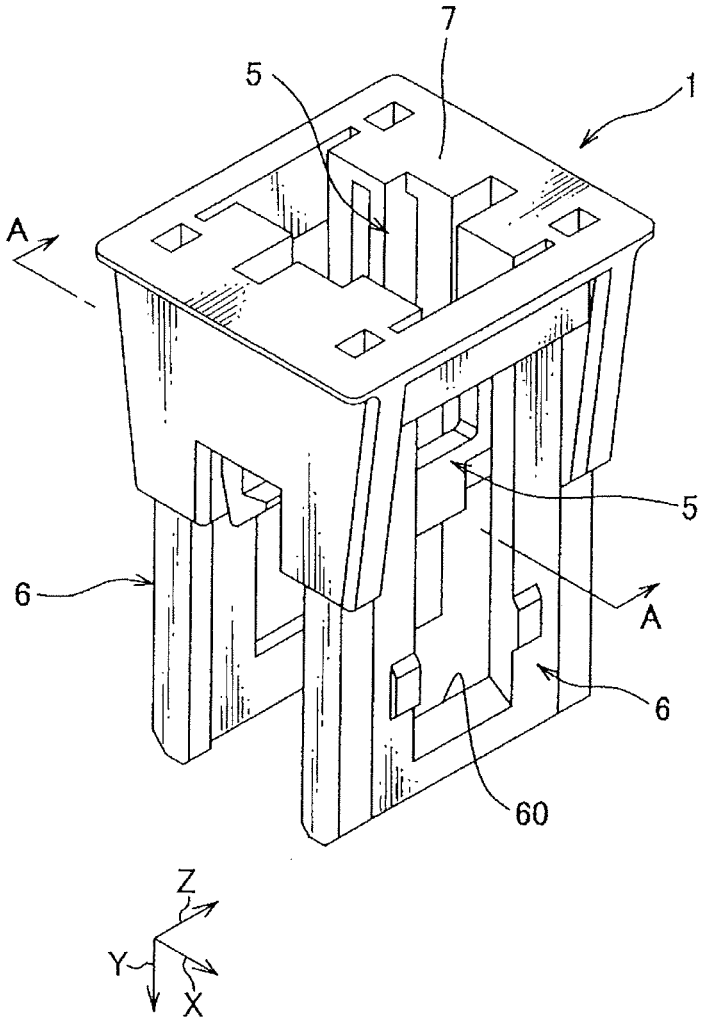
FIG. 1 is a perspective view of one embodiment of a fuse holder in accordance with the invention.
Figure 2:
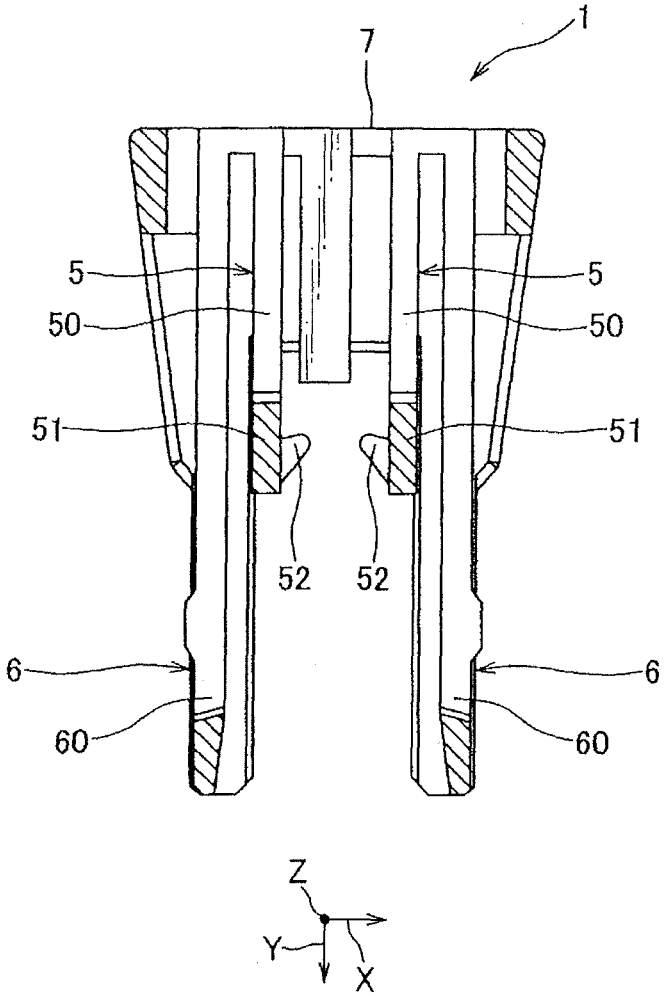
FIG. 2 is a cross-sectional view taken along line A-A of FIG. 1.

The fuse holder as shown in FIGS. 1 and 2 corresponds to a part or component which is configured to couple or decouple a fuse with respect to a frame 3 of an electric junction box as shown in FIGS. 4-7 while retaining the fuse 2 therein.

The electric junction box is to be mounted to a vehicle, and is configured to supply or distribute electric power from a battery into a plurality of electrical components. The electric junction box has a frame 3 which is shown to include a portion or space 30 to which the fuse 2 and the fuse holder 1 are attached, and portions or spaces 38, 39 to which any necessary component(s) or part(s) other than the fuse 2 and the fuse holder 1 is(are) attached. The frame 3 can be formed of synthetic resin.

Figure 5:
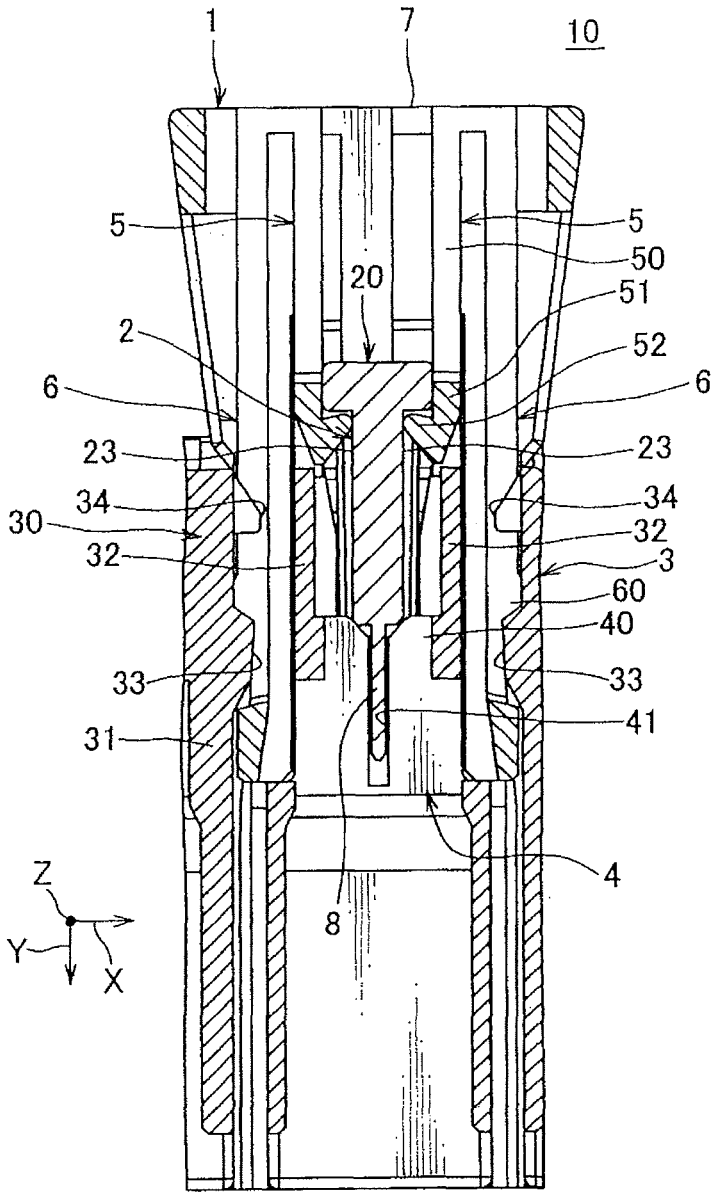
FIG. 5 is a cross-sectional view taken along line C-C of FIG. 4.

Referring to FIG. 5, the frame 3 is capable of receiving a bus bar 4 which is configured to electrically connect the electric components or parts together which are attached or coupled to the frame 3. The bus bar 4 can be produced by pressing a metallic plate or metallic sheet, and have a connecting terminal 40 which is electrically connected to the fuse 2. The connecting terminal 40 has a slot 41 for inserting a terminal 8 of the fuse 2 thereinto.

As mentioned previously, the electric junction box 1 is equipped with a fuse-connecting structure 10 which has the fuse holder 1, the fuse 2, the frame 3 and the connecting terminal 40.

Figure 8:
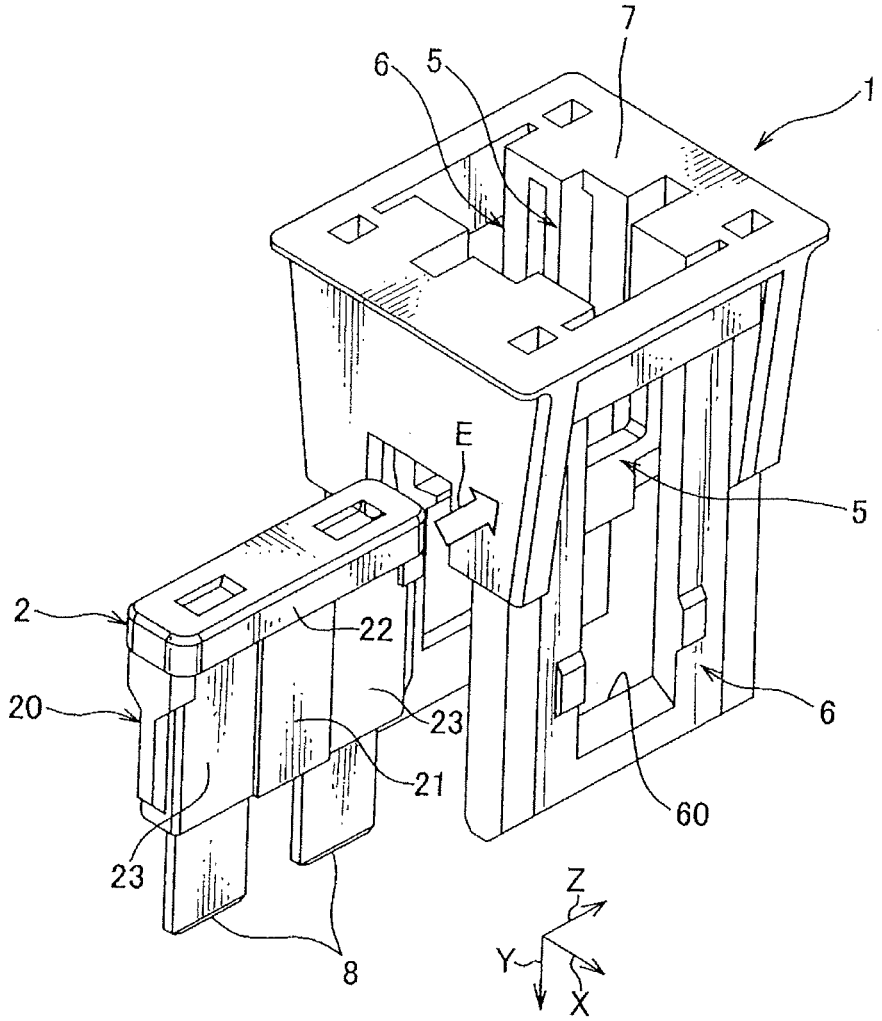
FIG. 8 is provided for illustrating alternative example to attach or couple the fuse to the fuse holder of FIG. 1.

The fuse 2 is a part or component of a circuit for supplying electric power from a battery into a clock, a smart key, or other electrical components such as an antitheft device. Referring to FIG. 8, the fuse 2 is shown to include a housing 20 formed of synthetic resin, a pair of terminals 8 extending from the housing 20, and a fusible element received in the housing 20. Moreover, the housing 20 has a rectangular-shaped body portion 21, a flange portion 22 foiled in one end of the body portion 21, and a recess 23 formed in both opposed sides of the body portion 21. The pair of terminals 8 projects from or extends from the other end of the body portion 21. The two recesses 23 are foil red for each side (i.e. side surface). Furthermore, the two recesses 23 are arranged in line with the pair of terminals 8. In other words, the two recesses 23 are arranged in parallel with the pair of terminal 8. A pair of flexible arms 5 of the fuse holder 1 engages with the recesses 23. The recess 23 corresponds to "a portion with which the pair of flexible arms engages" as recited in the attached claims.

The fuse holder 1 can be formed of synthetic resin, and has a base portion 7, a pair of flexible arms 5 extending from the outer edge or face of the base portion 7 in a direction indicated by an arrow "Y" (see FIG. 8), and a pair of locking arms 6 extending from the outer edge or face of the base portion 7 in a direction as indicated by the arrow "Y" and located lateral to the pair of the flexible arms 5, as shown in FIGS. 1 and 2. The pair of flexible arms 5 is configured to engage with the fuse 2; as well as, to sandwich the fuse 2 therebetween. The pair of locking arms 6 is made engageable with the frame 3. In this regard, a direction as indicated by the arrow "Y" can be defined by a direction in which the fuse holder 1 is attached or coupled to the frame 3. Furthermore, the direction as indicated by an arrow "X", and the direction as indicated by an arrow "Y" bisect each other at right angles. The direction as indicated by an arrow "Z" is orthogonal to both the direction as indicated by the arrow "X" and the direction as indicated by the arrow "Y".

Figure 9:
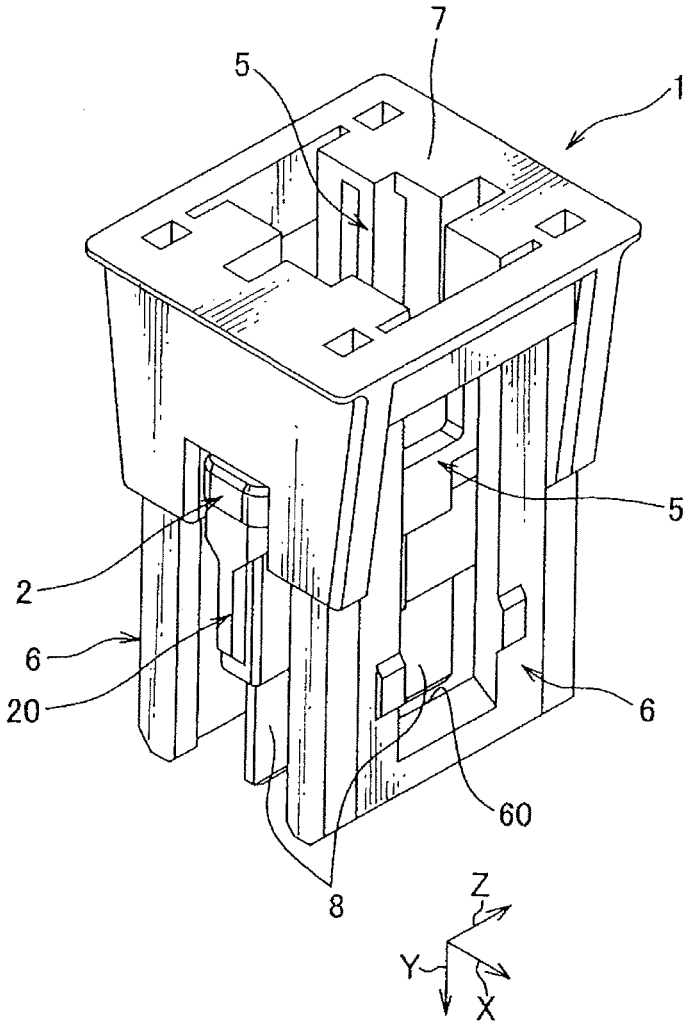
FIG. 9 is a perspective view depicting a state in which the fuse is attached or coupled to the fuse holder of FIG. 8.

The pair of flexible arms 5 is arranged apart from each other in the direction as indicated by the arrow "X". Each flexible arm 5 is shown to include a pair of flexible portions 50, a connecting portion 51 in which the pair of flexible portions 50 is connected to each other at each one end portion, and a pair of projections 52 extending from both end portions of the connecting portion 51, which are disposed in a direction as indicated by "Z", toward the opposite flexible arm 5. The pair of flexible portions 50 is spaced apart from each other in a direction as indicated by the mow "Z" and extends from the outer edge or surface of the base portion 7 in a direction as indicated by the arrow "Y". As shown in FIGS. 5 and 9, four projections 52 are capable of engaging with four depressions 23 of the fuse 2 respectively, thereby retaining the fuse 2 therein. As such, the fuse 2 can be attached or mounted to the fuse holder 1.

The pair of locking arms 6 is arranged apart from each other in a direction as indicated by the arrow "X". Each locking arm 6 can be formed in the shape of a plate or sheet. There is provided a through-hole 60 in the center of the locking arm 6. As a result, each locking arm is formed in the shape of a frame. Between each locking arm 6 and each flexible arm 5, there is provided a gap or clearance. Due to the gap or clearance the pair of flexible arms 5 is capable of bend in a direction away from each other (i.e., a direction as indicated by the arrow "X").

Figure 3:
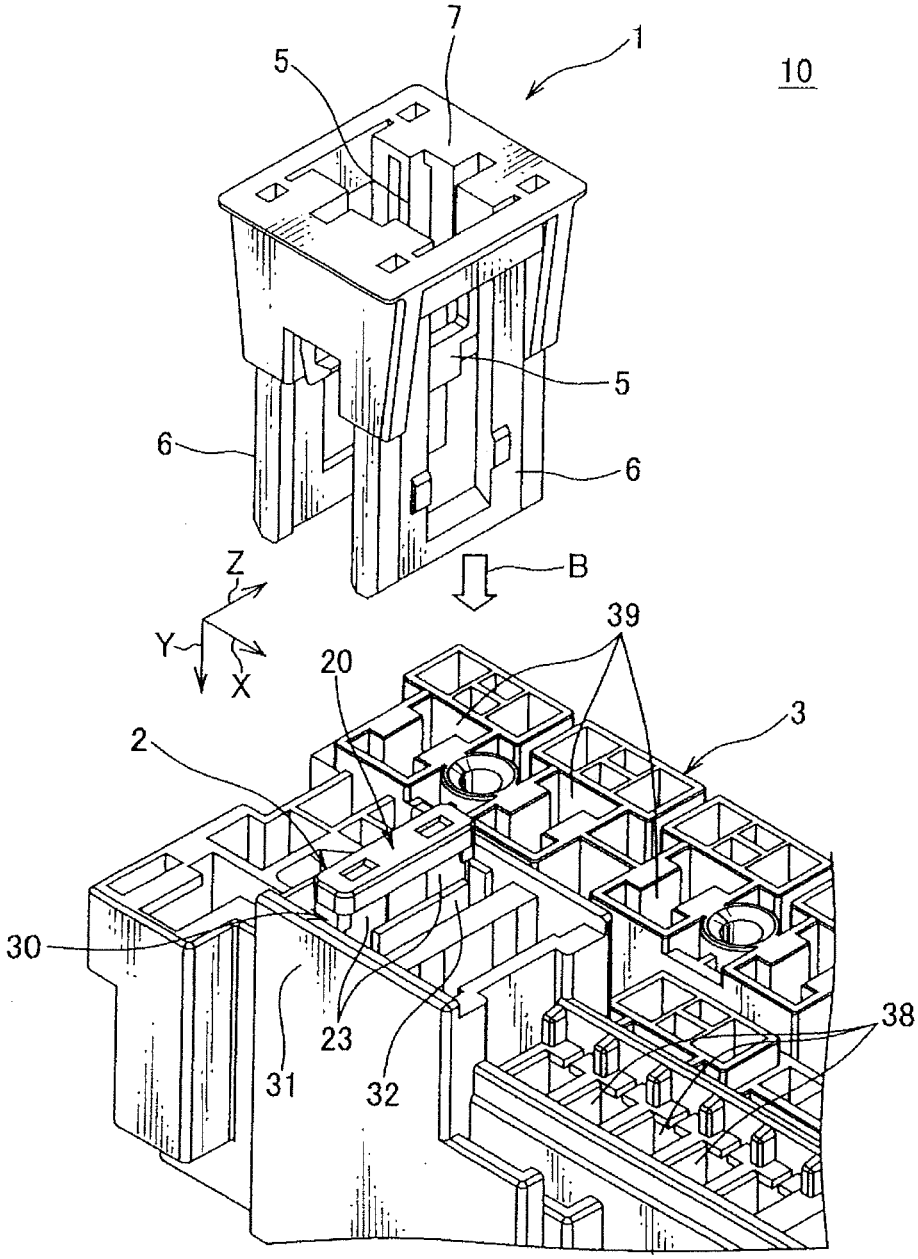
FIG. 3 is provided for illustrating an example to attach or couple a fuse to the fuse holder of FIG. 1.

Referring to FIG. 3, a method for attaching or coupling the fuse 2 to the fuse holder 1 can be described. The fuse 2 and the fuse holder 1 can be approximated in a direction as indicated by the arrow "Y" (i.e., B direction), and then the fuse 2 can be attached or coupled upwardly to the fuse holder 1 by jamming the fuse 2 between the pair of flexible arms 5 of the fuse holder 1. Alternatively, as shown in FIG. 8, the fuse 2 and the fuse holder 1 can be approximated in a direction as indicated by the arrow "Z" (i.e., E direction), and then the fuse 2 can be attached or coupled to the fuse holder 1 by laterally sliding the fuse 2 between the pair of flexible arms 5 of the fuse holder 1. In other words, the invention proposes above two methods for attaching or coupling the Rise 2 to the fuse holder 1.

In the former method as shown in FIG. 3, the flexible portion 50 can be temporarily deformed elastically toward the locking arm 6 when the flange 22 of the fuse 2 passes between the pair of projections 52. The flexible portion 50 is then recovered from the deformed state after the flange 22 of the fuse 2 passes between the pair of projections 52, thereby allowing the projection 52 to engage with the depression 23 of the fuse 2. On the other hand, in the latter method as shown in FIG. 8, the flexible portion 50 is not elastically deformed.

With reference to FIGS. 3 to 7, the portion or space 30 to which the fuse 2 and the fuse holder 1 are attached is comprised of a circumferential wall 31 configured to position the fuse holder 1 therein, a pair of inner walls 32 disposed inside the circumferential wall 31 and configured to sandwich the fuse 2 therebetween, a first lock 33 disposed on each of the opposed inner surfaces of the circumferential wall 31, and a second lock 34 disposed on each of the opposed inner surfaces of the circumferential wall 31.

Figure 6:
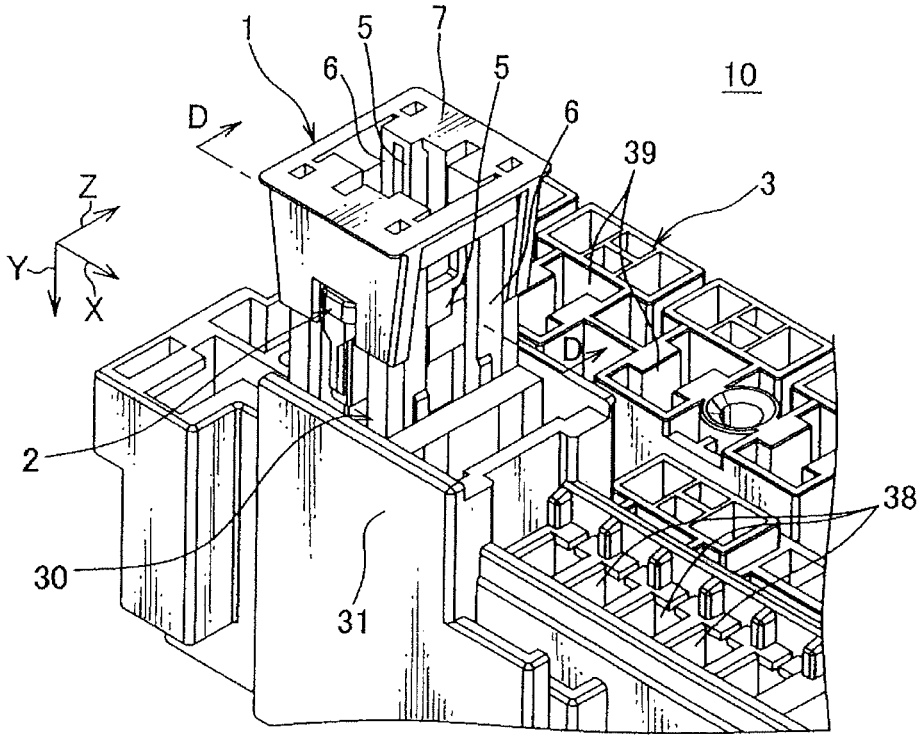
FIG. 6 is a perspective view depicting a state in which the fuse is decoupled or disconnected from the frame by means of the fuse holder of FIG. 4.
Figure 7:
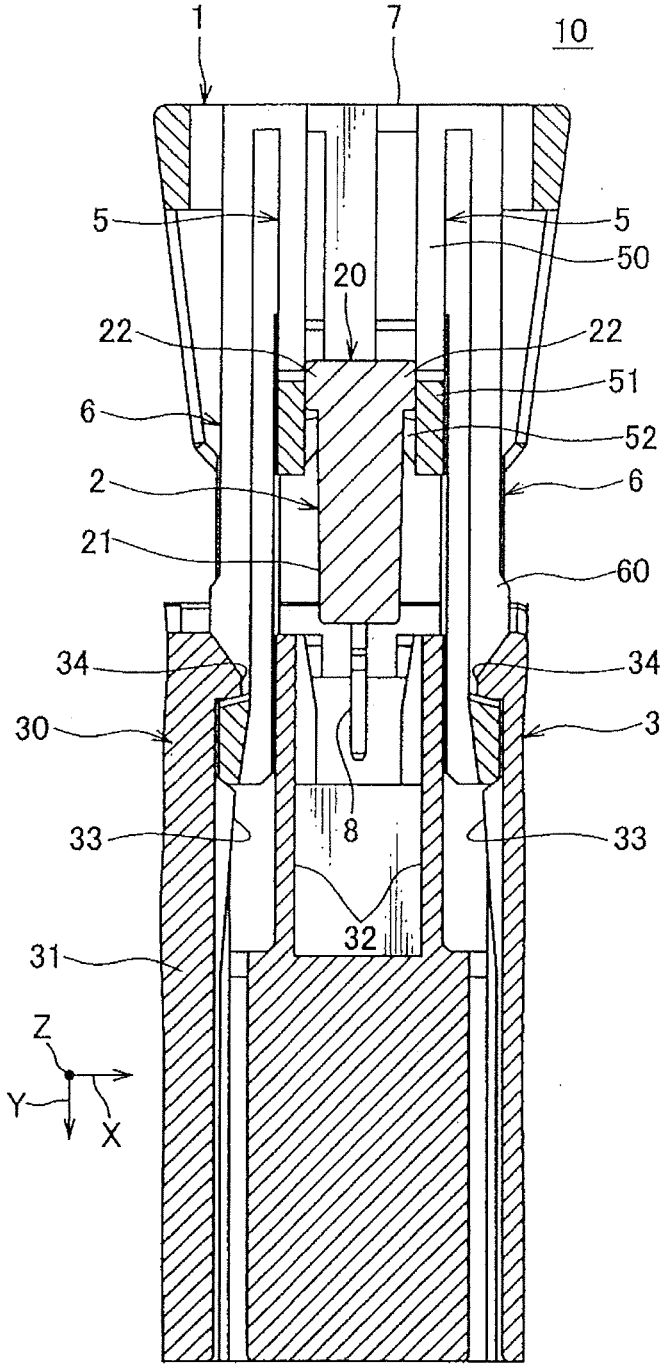
FIG. 7 is a cross-sectional view taken along line D-D of FIG. 6.

The distance between one opened end portion of the circumferential wall 31 and the second lock 34 is less than the distance between the opened end portion of the circumferential wall 31 and the first lock 33. The first lock 33 and the second lock 34 can be locked with the through-hole 60 formed in the locking arm 6 of the fuse holder 1. Moreover, referring to FIGS. 4 and 5, the locking arm 6 is locked with the first lock 33, thereby maintaining the state that the terminal 8 of the fuse 2 retained in the fuse holder 1 is inserted into the slot 41 of the connecting terminal 40. With reference to FIGS. 6 and 7, the locking arm 6 is locked with the second lock 34, thereby maintaining the state in which the terminal 8 of the fuse 2 retained in the fuse holder 1 is positioned outside the slot 41 of the connecting terminal 40.

As mentioned previously, the fuse holder 1 can be attached or coupled to the frame 3 such that it can be moved between a first position in which the fuse 2 is electrically connected to the connecting terminal 40 disposed in the frame 3 and a second position in which the fuse 2 is disconnected or decoupled from the connecting terminal 40 while retaining the fuse 2 therein.

Referring to FIG. 3, the fuse 2 is capable of being attached or coupled to the portion or space 30 even if it is not retained in the fuse holder 1. In other words, the fuse 2 can be electrically connected to the connecting terminal 40 disposed in the frame 3 in an independent manner.

Next, there will be illustrated a method for connecting the fuse 2 by using the fuse holder 1.

Figure 4:
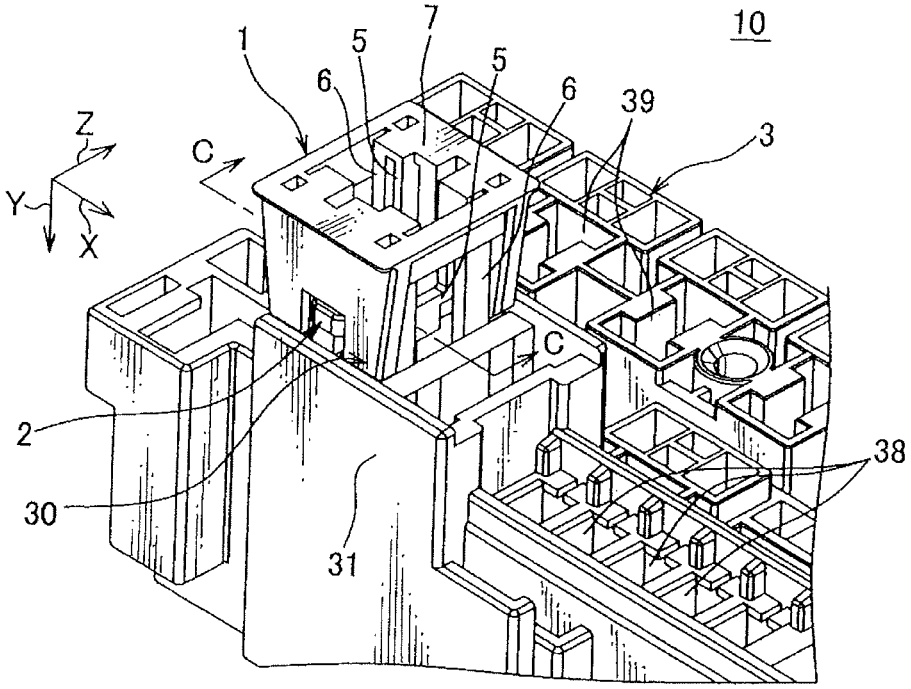
FIG. 4 is a perspective view depicting a state in which the fuse holder of FIG. 3 is attached or coupled to a frame and the fuse.

Firstly, with reference to FIG. 3, the fuse 2 which is not retained in the fuse holder 1 is attached or coupled to the portion or space 30 of the frame 3. Subsequently, the fuse holder 1 is inserted into the portion or space 30 of the frame 3 in the same direction as the fuse 2 is attached to the portion or space 30 (i.e. B direction) such that the fuse holder 1 is attached or coupled to the frame 3 and the fuse 2 is attached or coupled to the fuse holder 1. After the completion of the afore-mentioned operation, the fuse holder 1 is arranged in the first position as shown in FIGS. 4 and 5, and the fuse 2 is electrically connected to the connecting terminal 40. Furthermore, as mentioned previously, in a case where the fuse 2 is intended to be attached to the fuse holder 1, the flange 22 of the fuse 2 abuts against the projection 52 of the pair of flexible arms 5 immediately before the fuse holder 1 is arranged in the first position. At this point, the pair of flexible arms 5 is temporarily bent such that they are away from each other. Due to elastic restoring force of the flexible arm 5, the pair of flexible arms 5 can be restored to its normal state (i.e., non-deformed state), thereby allowing the fuse 2 to be attached to the fuse holder 1. In addition, the pair of flexible arms 5 will not bend after the fuse 2 is attached to the fuse holder 1.

In order to prevent dark current from flowing into the electrical component of the vehicle, the fuse holder 1 can be lifted from the first portion as shown in FIGS. 4 and 5 to the second position as shown in FIGS. 6 and 7. As a result, the fuse 2 is decoupled or disconnected from the connecting terminal 40. On the other hand, in order to electrically connect the fuse 2 to the connecting terminal 40 once gain, the fuse holder 1 can be situated from the second position as shown in FIGS. 6 and 7 to the first position as shown in FIGS. 4 and 5.

As such, the pair of flexible arms 5 is formed such that it can be bent in a direction away from each other. As a result, the fuse holder 1 can be attached or coupled to the assembly of the fuse 2 and the frame 3 after the fuse 2 is attached to the frame 3. Accordingly, a product with or without the fuse holder 1 can be commonly produced by the afore-mentioned process or step of attaching or coupling the fuse 2 to the frame 3. Alternatively, the fuse holder 1 may be attached or coupled to the frame 3 after the attachment of the fuse 2 to the fuse holder 1.

For reference, a product equipped with the fuse holder 1 may be an electric junction box for a vehicle for export, and a product without the fuse holder 1 may be an electric junction box for a vehicle for domestic demand.

Due to the fuse-connecting structure 10 equipped with the fuse holder 1 the fuse 2 which is decoupled from the connecting terminal 40 can be protected from any loss or damage.

The inventive method for connecting the fuse by using the fuse holder 1 makes it easy to disconnect the fuse 2 from the connecting terminal 40, as well as, to electrically connect the fuse 2 to the connecting terminal 40.

Figure 10:
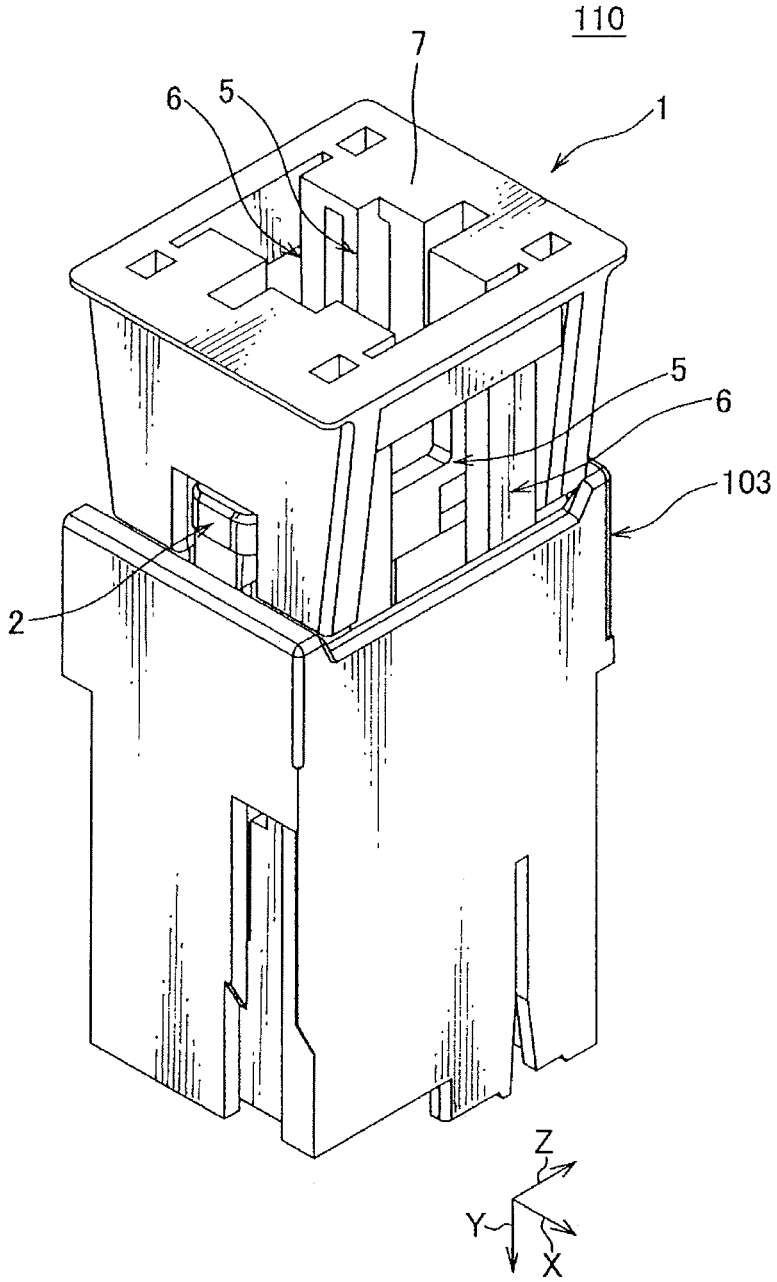
FIG. 10 is a perspective view depicting the fuse holder as shown in FIG. 3 and a frame which is different from the frame as shown in FIG. 3.
Figure 11:
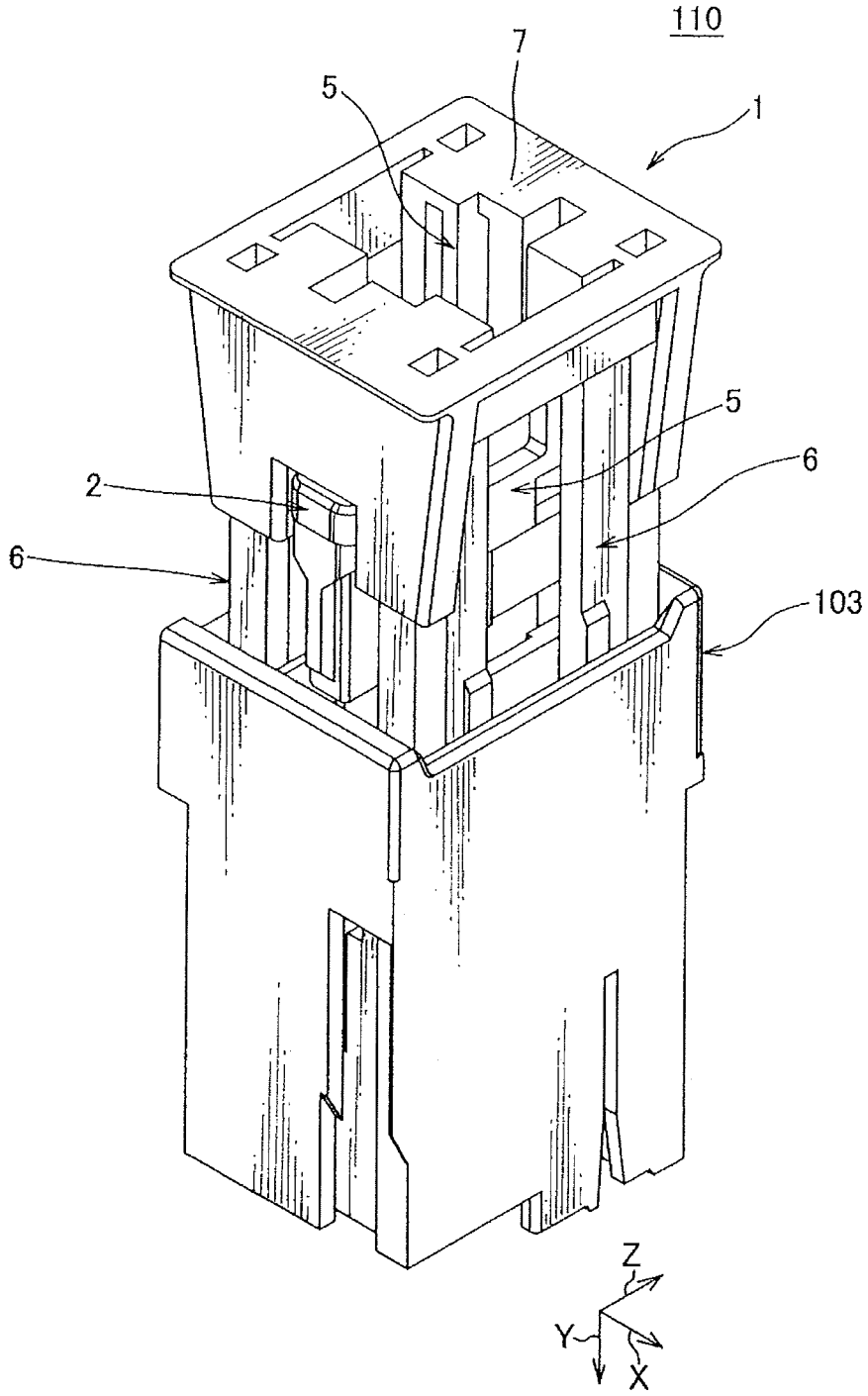
FIG. 11 is a perspective view depicting a state in which the fuse is decoupled from the frame by means of the fuse holder as shown in FIG. 10.

The inventive fuse-connecting structure equipped with the fuse holder 1 can also employ a frame 103 as shown in FIGS. 10 and 11 in place of the frame 3 as mentioned above. In other words, a fuse-connecting structure 110 equipped with the fuse holder 1 has the fuse holder 1, the fuse 2, the frame 103, and the connecting terminal received in the frame 103, as shown in FIGS. 10 and 11.

The frame 103 is formed of synthetic resin, and has a constitution which is substantially equal to the portion or space 30 to which the fuse 2 and the fuse holder 1 are attached.

As such, the frame can have at least one portion or space to which a component(s) or part(s) is attached. Moreover, the frame as stated above is not necessarily disposed in the electric junction box. In addition, the connecting terminal may be a part of the bus bar, or may be connected to the terminal of an electrical wire.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fuse holder, comprising:

a single and sole pair of flexible arms being capable of elastically deformed and extending from a base in a direction same as that of the fuse holder is attached to a frame, a pair of lock arms capable of being engaged with the frame, wherein the fuse holder is moveably attached or coupled to the frame when retaining the fuse therein such that it can be situated between a first position in which the fuse is electrically connected to a connecting terminal disposed in the frame, and a second position in which the fuse is electrically disconnected or decoupled from the connecting terminal;

wherein the fuse holder is made movable between the first position and the second position maintaining a state directly attached to the frame while holding the fuse by the pair of lock arms, wherein the pair of flexible arms is integrally formed with each other, sandwiches the fuse therebetween, and engages with the fuse when the fuse holder is attached to the frame; and wherein the pair of flexible arms which sandwiches the fuse therebetween is bent in a direction away from each other such that the fuse holder is also capable of being moved to hold the fuse that is in a state securely attached to the frame to be electrically connected to the connecting terminal.

2. A method for connecting fuse by using the fuse holder according to claim 1, comprising the steps of:

attaching or coupling the fuse, which is not retained in the fuse holder, to the frame, and subsequently inserting the fuse holder into the frame to which the fuse is attached or coupled to the frame, thereby attaching or coupling the fuse holder to both the frame and the fuse.

3. A structure, comprising:

the fuse holder as defined in claim 1, the fuse, the frame, and the connecting terminal.

4. The fuse holder according to claim 1, wherein each of the pair of flexible arms comprises: flexible portions; a connecting portion connecting the flexible portions to each other; and projections extending from the flexible portions toward another of the pair of flexible arms.

5. The fuse holder according to claim 4, wherein the projections of the each of the pair of flexible arms are in engagement with recessed portions formed on the fuse.

6. The method according to claim 2, further comprising steps of:

lifting the fuse holder from the first position to the second position in order to prevent dark current from flowing into an electrical component of a vehicle; and situating the fuse holder from the second position to the first position in order to electrically connect the fuse to the connecting terminal.

7. The method according to claim 2, further comprising steps of:

removably attaching the fuse to the fuse holder when the fuse is intended to be attached to the fuse holder; and subsequently inserting the fuse holder into the frame, thereby removably attaching the fuse to the frame.

8. The fuse holder according to claim 1, wherein the pair of flexible arms is arranged apart from each other to define a space for accepting a fuse to be coupled with the fuse holder, the space being accessible by the fuse from more than one direction.

9. The fuse holder according to claim 1, wherein both of terminals of the fuse are electrically connected to the connecting terminal disposed in the frame when the fuse holder is situated at the first position.

* * * * *